US012324508B2

(12) United States Patent
Novak

(10) Patent No.: US 12,324,508 B2
(45) Date of Patent: Jun. 10, 2025

(54) MECHANICAL STRUCTURAL SUPPORT WITH ASYMMETRIC OPPOSING ANGLES

(71) Applicant: Jay Novak, Beverly Hills, CA (US)

(72) Inventor: Jay Novak, Beverly Hills, CA (US)

( * ) Notice: Subject to any disclaimer, the term of this patent is extended or adjusted under 35 U.S.C. 154(b) by 0 days.

(21) Appl. No.: 18/764,372

(22) Filed: Jul. 5, 2024

(65) Prior Publication Data

US 2025/0009122 A1 Jan. 9, 2025

Related U.S. Application Data

(60) Provisional application No. 63/512,060, filed on Jul. 5, 2023.

(51) Int. Cl.
*A47B 13/02* (2006.01)

(52) U.S. Cl.
CPC ..... *A47B 13/021* (2013.01); *A47B 2200/002* (2013.01)

(58) Field of Classification Search
CPC .. A47B 13/021; A47B 13/00; A47B 2200/002
See application file for complete search history.

(56) References Cited

U.S. PATENT DOCUMENTS

2011/0094493 A1* 4/2011 Malumyan ..... A47J 37/0704 126/25 R

FOREIGN PATENT DOCUMENTS

| | | | | |
|---|---|---|---|---|
| KR | 2009028748 A | * | 3/2009 | |
| KR | 1273447 B1 | * | 6/2013 | |
| KR | 20150108510 A | * | 9/2015 | |
| KR | 2016039840 A | * | 4/2016 | ..... A47J 37/00 |
| KR | 20220166032 A | * | 12/2022 | |

* cited by examiner

*Primary Examiner* — Eret C McNichols
(74) *Attorney, Agent, or Firm* — ALONZO & ASSOCIATES; Arlyn Alonzo

(57) ABSTRACT

Aspects of the disclosure are directed to mechanical structural supports which includes a first primary member; a first secondary member connected to the first primary member at a first angle at a first point; a first connecting piece connected to the first secondary member at a second angle at a second point; a second secondary member connected to the first primary member at a third angle at a third point; a second connecting piece connected to the second secondary member at a fourth angle at a fourth point; a planar surface connected to the first connecting piece and the second connecting piece, wherein the first connecting piece is offset relative to a first line projected onto the surface by the first primary member, and the second connecting piece is offset in an opposite direction relative to the first line.

10 Claims, 20 Drawing Sheets

MECHANICAL STRUCTURAL SUPPORT WITH ASYMMETRIC OPPOSING ANGLES

CLAIM OF PRIORITY UNDER 35 U.S.C. § 119

The present Application for Patent claims priority to Provisional Application No. 63/512,060 entitled "MECHANICAL STRUCTURAL SUPPORT WITH ASYMMETRIC OPPOSING ANGLES" filed Jul. 5, 2023, and assigned to the assignee hereof and hereby expressly incorporated by reference herein.

TECHNICAL FIELD

This disclosure relates generally to the field of mechanical supports, and, in particular, to mechanical structural supports.

BACKGROUND

Structural supports for various applications, such as furniture, typically have vertical or symmetric slanting member elements on a first axis. For increased mechanical stability under shear, compressive and tensile stress, alternative structural support design geometries may be introduced for improved mechanical performance and robustness.

SUMMARY

The following presents a simplified summary of one or more aspects of the present disclosure, in order to provide a basic understanding of such aspects. This summary is not an extensive overview of all contemplated features of the disclosure, and is intended neither to identify key or critical elements of all aspects of the disclosure nor to delineate the scope of any or all aspects of the disclosure. Its sole purpose is to present some concepts of one or more aspects of the disclosure in a simplified form as a prelude to the more detailed description that is presented later.

In one aspect, the disclosure provides mechanical structural support with asymmetric opposing angles. Accordingly, the present disclosure discloses an apparatus including: a first primary member; a first secondary member connected to the first primary member at a first point and wherein the first secondary member connects to the first primary member at a first angle at the first point; a first connecting piece connected to the first secondary member at a second point and wherein the first connecting piece connects to the first secondary member at a second angle at the second point; a second secondary member connected to the first primary member at a third point and wherein the second secondary member connects to the first primary member at a third angle at the third point; a second connecting piece connected to the second secondary member at a fourth point and wherein the second connecting piece connects to the second secondary member at a fourth angle at the fourth point; and a planar surface connected to the first connecting piece and the second connecting piece, wherein the first connecting piece is offset relative to a first line projected onto the surface by the first primary member and the second connecting piece is offset in an opposite direction relative to the first line.

In one example, the first angle is less than 90 degrees and the third angle is less than 90 degrees. In one example, the second angle is a right angle and the fourth angle is a right angle. In one example, the first connecting piece is symmetrically offset in the opposite direction to the second connecting piece relative to the first line. In one example, the offset is zero degrees. In one example, each of the first connecting piece and the second connecting piece points inward relative to each other.

In one example, the apparatus further includes a second primary member; a third secondary member connected to the second primary member at a fifth point and wherein the third secondary member connects to the second primary member at a fifth angle at the fifth point; a third connecting piece connected to the third secondary member; a fourth secondary member connected to the second primary member at a sixth point and wherein the fourth secondary member connects to the second primary member at a sixth angle at the sixth point; and a fourth connecting piece connected to the fourth secondary member; wherein the third connecting piece connects to the planar surface, and the fourth connecting piece connects to the planar surface.

In one example, the third connecting piece is offset relative to a second line projected onto the surface by the second primary member, and the fourth connecting piece is offset in an opposite direction relative to the third connecting piece and relative to the second line. In one example, the fifth angle and the sixth angle are each a right angle. In one example, the fifth angle is less than 90 degrees and the sixth angle is less than 90 degrees. In one example, the third secondary member and the fourth secondary member form a first crisscrossed pattern. In one example, the first secondary member and the second secondary member form a second crisscrossed pattern. In one example, each of the first connecting piece and the second connecting piece points inward relative to each other. In one example, each of the third connecting piece and the fourth connecting piece points inward relative to each other.

In one example, the apparatus further includes a first floor pad, a second floor pad, a third floor pad and a fourth floor pad, wherein the first floor pad and the second floor pad are connected to the first primary member, and wherein the third floor pad and the fourth floor pad are connected to the second primary member. In one example, each of the first connecting piece and the second connecting piece points outward relative to each other. In one example, each of the third connecting piece and the fourth connecting piece points outward relative to each other.

In one example, the apparatus further includes a first floor pad, a second floor pad, a third floor pad and a fourth floor pad, wherein the first floor pad and the second floor pad are connected to the first primary member, and wherein the third floor pad and the fourth floor pad are connected to the second primary member.

In one example, the first connecting piece is offset to the left relative to the first line; the second connecting piece is offset to the right relative to the first line; the third connecting piece is offset to the right relative to the second line; and the fourth connecting piece is offset to the left relative to the second line to form a first distance between the first connecting piece and the third connecting piece and a second distance between the second connecting piece and the fourth connecting piece such that the first distance is longer than the second distance.

In one example, the first connecting piece is offset to the right relative to the first line; the second connecting piece is offset to the left relative to the first line; the third connecting piece is offset to the left relative to the second line; and the fourth connecting piece is offset to the right relative to the second line to form a first distance between the first connecting piece and the third connecting piece and a second distance between the second connecting piece and the fourth connecting piece such that the first distance is shorter than the second distance.

These and other aspects of the present disclosure will become more fully understood upon a review of the detailed description, which follows. Other aspects, features, and implementations of the present disclosure will become apparent to those of ordinary skill in the art, upon reviewing the following description of specific, exemplary implementations of the present invention in conjunction with the accompanying figures. While features of the present invention may be discussed relative to certain implementations and figures below, all implementations of the present invention can include one or more of the advantageous features discussed herein. In other words, while one or more implementations may be discussed as having certain advantageous features, one or more of such features may also be used in accordance with the various implementations of the invention discussed herein. In similar fashion, while exemplary implementations may be discussed below as device, system, or method implementations it should be understood that such exemplary implementations can be implemented in various devices, systems, and methods.

DETAILED DESCRIPTION

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known structures and components are shown in block diagram form in order to avoid obscuring such concepts.

While for purposes of simplicity of explanation, the methodologies are shown and described as a series of acts, it is to be understood and appreciated that the methodologies are not limited by the order of acts, as some acts may, in accordance with one or more aspects, occur in different orders and/or concurrently with other acts from that shown and described herein. For example, those skilled in the art will understand and appreciate that a methodology could alternatively be represented as a series of interrelated states or events, such as in a state diagram. Moreover, not all illustrated acts may be required to implement a methodology in accordance with one or more aspects.

Mechanical designs for various products, such as furniture designs, incorporate structural supports to carry various mechanical loads to an underlying foundation or floor. Mechanical loads are forces (in newtons, N), either static or dynamic, applied to structural elements which may be subject to different forms of mechanical stress. For example, a common mechanical load is a gravitational force, due to a load mass, which is directed vertically downward toward the center of the Earth. Stress is defined as force per unit area, where stress has units of newton per square meter ($N/m^2$).

Since mechanical stress is a vector force (i.e., a quantity with both magnitude and direction), it may be decomposed into constituent forms along a plurality of orthogonal axes. For example, mechanical stress may be in the form of shear stress, which is a force component parallel to cross section. For example, mechanical stress may be in the form of compressive stress, which is a force component perpendicular to cross section acting as a contracting force. For example, mechanical stress may be in the form of tensile stress, which is a force component perpendicular to cross section acting as an expanding force.

Figure 1:
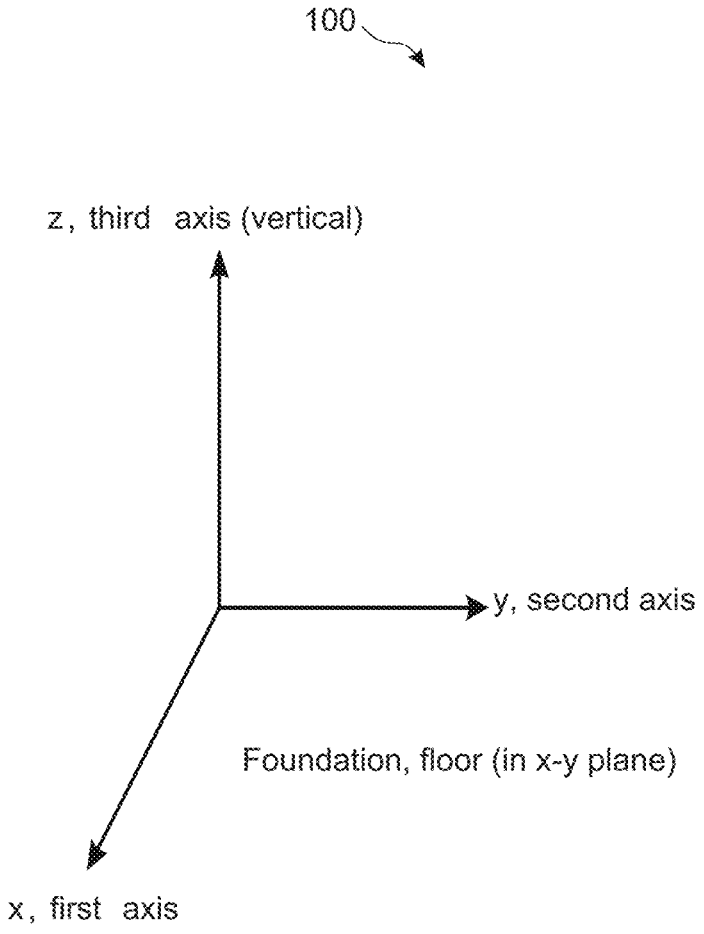
FIG. 1 illustrates an example reference geometry with a set of reference orthogonal axes (x, y, z).

In one example, a mechanical design is not only implemented for aesthetic reasons but also to sustain mechanical stability under various forms of mechanical stress. The mechanical design may be described relative to a set of reference orthogonal axes (x, y, z) where a first axis (x) and a second axis (y) may be defined as coplanar with a foundation or floor. Moreover, a third axis (z) may be defined as perpendicular or vertical to the foundation or floor and therefore orthogonal to the first axis and second axis. FIG. 1 illustrates an example reference geometry 100 with a set of reference orthogonal axes (x, y, z). In FIG. 1, the foundation (or floor) is in the x-y plane.

In one example, the mechanical design may include a support structure with a primary member, a first secondary member and a second secondary member. In one example, the support structure is formed of one piece shaped into a contiguous form of connected members (e.g., the primary member connected to the first secondary member and the second secondary member). In one example, the mechanical design may have a plurality of support structures with each support structure having a primary member, a first secondary member and a second secondary member.

In one example, the mechanical design may have the support structure positioned with the primary member aligned along the first axis (x) and coplanar with the foundation or floor (which is in the x-y plane). In another example, the mechanical design may have the support structure positioned with the primary member aligned along the first axis (x) and the support structure be tilted with respect to the foundation or floor (which is in the x-y plane).

In one example, the first secondary member and the second secondary member may be aligned along the plane containing the first axis (x) and the third axis (z), i.e., coplanar with the x-z plane. In one example, the first secondary member may have a first cant angle with respect to the primary member which is less than 90 degrees (i.e., first cant angle is an acute angle). In one example, the second secondary member may have a second cant angle with respect to the primary member which is less than 90 degrees (i.e., second cant angle is an acute angle). In one example, the first cant angle and the second cant angle are tilted in opposite directions in the x-z plane. In one example, the first cant angle and the second cant angle are tilted with an inner cant (i.e., towards each other). In one example, the first cant angle and the second cant angle are tilted with an outer cant (i.e., away from each other).

Figure 2:
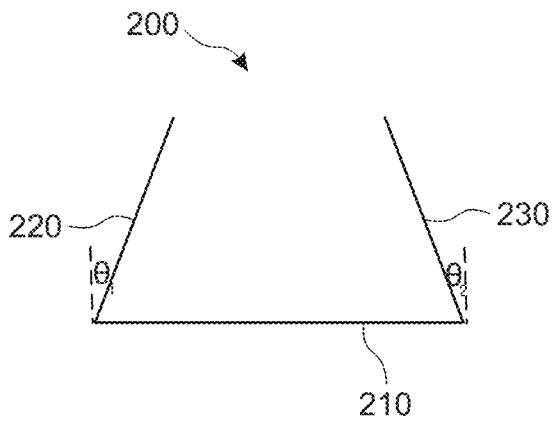
FIG. 2 illustrates a first example support structure with an inner cant.

FIG. 2 illustrates a first example support structure 200 with an inner cant. For example, the first example support structure 200 includes a primary member 210 coplanar with a foundation or floor (which is in the x-y plane). The first example support structure 200 also includes a first secondary member 220 and a second secondary member 230 attached to opposite sides of the primary member 210. Each of the first secondary member 220 and the second secondary member 230 includes a cant angle such that the first secondary member 220 and the second secondary member 230 are tilted towards each other as illustrated in FIG. 2. That is, the inner cant results in the first secondary member 220 and the second secondary member 230 rising from the primary member 210 with an inter-member distance which decreases with height from the foundation or floor. And, in one example, an angle $\theta_1$ between the first secondary member 220 and the x-z plane is less than 90 degrees, and an angle $\theta_2$ between the second secondary member 230 and the x-z plane is less than 90 degrees.

Figure 3:
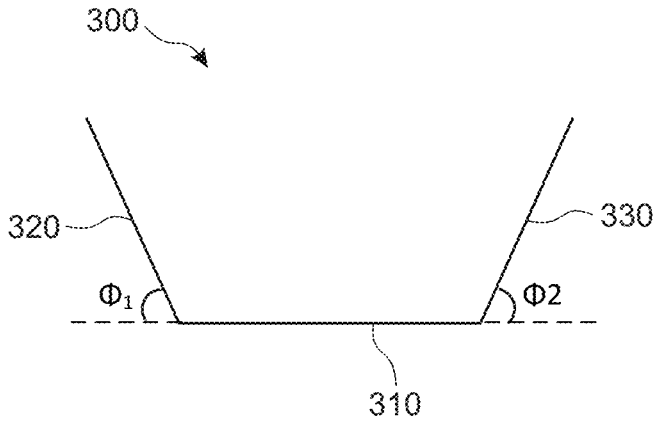
FIG. 3 illustrates a second example support structure with an outer cant.

FIG. 3 illustrates a second example support structure 300 with an outer cant. For example, the second example support structure 300 includes a primary member 310 coplanar with a foundation or floor (which is in the x-y plane). The second example support structure 300 also includes a first secondary member 320 and a second secondary member 330 attached to opposite sides of the primary member 310. Each of the first secondary member 320 and the second secondary member 330 includes a cant angle such that the first secondary member 320 and the second secondary member 330 are tilted away from each other. That is, the outer cant results in the first secondary member 320 and the second secondary member 330 rising from the primary member 310 with an inter-member distance which increases with height from the foundation or floor. And, in one example, an angle $\phi_1$ between the first secondary member 320 and the x-y plane is less than 90 degrees, and an angle $\phi_2$ between the second secondary member 330 and the x-y plane is less than 90 degrees.

In one example, the support structure also includes a first connecting piece (e.g., a first connecting plate) attached to one end of the first secondary member with a first connecting angle, and a second connecting piece (e.g., a second connecting plate) attached to one end of the second secondary member with a second connecting angle. In one example, the first connecting piece is coplanar with the primary member. In one example, the second connecting piece is also coplanar with the primary member. In one example, the first connecting piece and the second connecting piece may include attachment hardware, such as screws, fasteners, adhesive bonds, etc. For example, the first connecting piece and the second connecting piece may be used to attach the support structure to a load member. In one example, the load member may be a table or platform which is supported by the support structure.

In one example, the support structure may be composed of metal (e.g., steel, stainless steel, aluminum, bronze, iron, copper, etc.). In one example, the support structure may be composed of composite material (e.g., Kevlar, carbon fiber, etc.). In one example, the support structure may be constructed of tubular shapes or flat shapes.

In one example, the support structure may be used to support a variety of mechanical loads such as furniture (e.g., table, desk, bench, etc.), automobile suspension system, a roof, food platters (e.g., pizza dish), building foundations (e.g., floor of a room or rooms), etc. One skilled in the art would understand that the examples listed herein of various mechanical loads do not exclude other mechanical loads that may be supported by support structures. Thus, other mechanical loads, not explicitly listed herein may be within the scope and spirit of the present disclosure.

Figure 4:
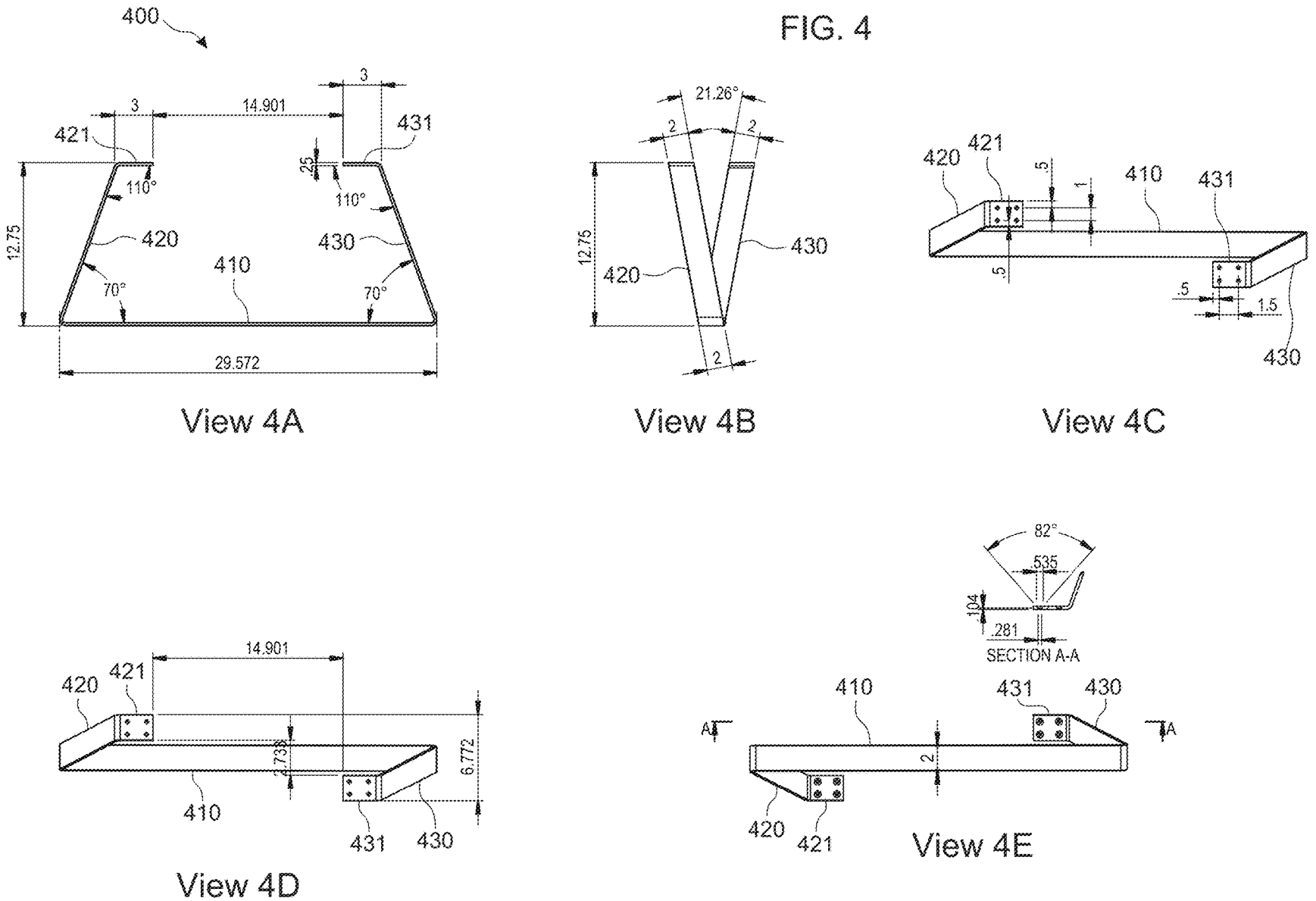
FIG. 4 illustrates an example first embodiment of a support structure.

FIG. 4 illustrates an example first embodiment of a support structure 400. FIG. 4 includes views. 4A, 4B, 4C, 4D & 4E. In one example, view 4A illustrates a side view of the first embodiment of the support structure 400 with a primary member 410, a first secondary member 420 with first connecting piece 421 and a second secondary member 430 with second connecting piece 431. As illustrated in FIG. 4, the first connecting piece 421 and the second connecting piece 431 are each pointing inward relative to the support structure.

For example, the first secondary member 420 has a first cant angle $\theta_1$ of ~70 degrees. For example, the second secondary member 430 has a second cant angle $\theta_2$ of ~70 degrees. In one example, the first cant angle $\theta_1$ and the second cant angle $\theta_2$ are tilted with an inner cant (i.e., towards each other). In one example, the first connecting piece 421 is connected to the first secondary member 420 with a first connecting angle of ~110 degrees. In one example, the second connecting piece 431 is connected to the second secondary member 430 with a second connecting angle of ~110 degrees. In one example, view 4B illustrates a side view of the two secondary members 420 and 430. Although dimensions of the support structure 400 are illustrated in FIG. 4, the dimensions may be viewed as one example showing proportions of the various members of the support structure 400 relative to one another. Additionally, the illustrated dimensions are only examples and one skilled in the art would understand that other proportions of the various members and other dimensions for the members of the support structure are within the scope and spirit of the present disclosure. And, in one aspect, the dimensions of each of the members of the support structure 400 may rely on particular applications (e.g., particular mechanical loads) of the support structure 400.

In one example, view 4C illustrates a first top view of the first embodiment of the support structure 400 which shows the first connecting piece 421 and the second connecting piece 431 at the top of the support structure 400. In addition, view 4C also shows the first secondary member 420 and the second secondary member 430 at the side of the support structure 400. In addition, view 4C also shows the primary member 410 at the bottom of the support structure 400. In one example, the primary member 410 is coplanar with the foundation or floor (e.g., in the x-y plane). In one example, the primary member 410 will be connected to a mechanical load.

In one example, view 4D illustrates a second top view of the first embodiment of the support structure 400 which shows additional dimensions from those shown in view 4C. In one example, view 4E shows a bottom view of the first embodiment of the support structure 400 which shows the primary member 410 at the bottom of the support structure 400. In addition, view 4E also shows the first secondary member 420 and the second secondary member 430 at the side of the support structure 400. In addition, view 4E also shows the first connecting piece 421 and the second connecting piece 431 at the top of the support structure 400.

Figure 5:
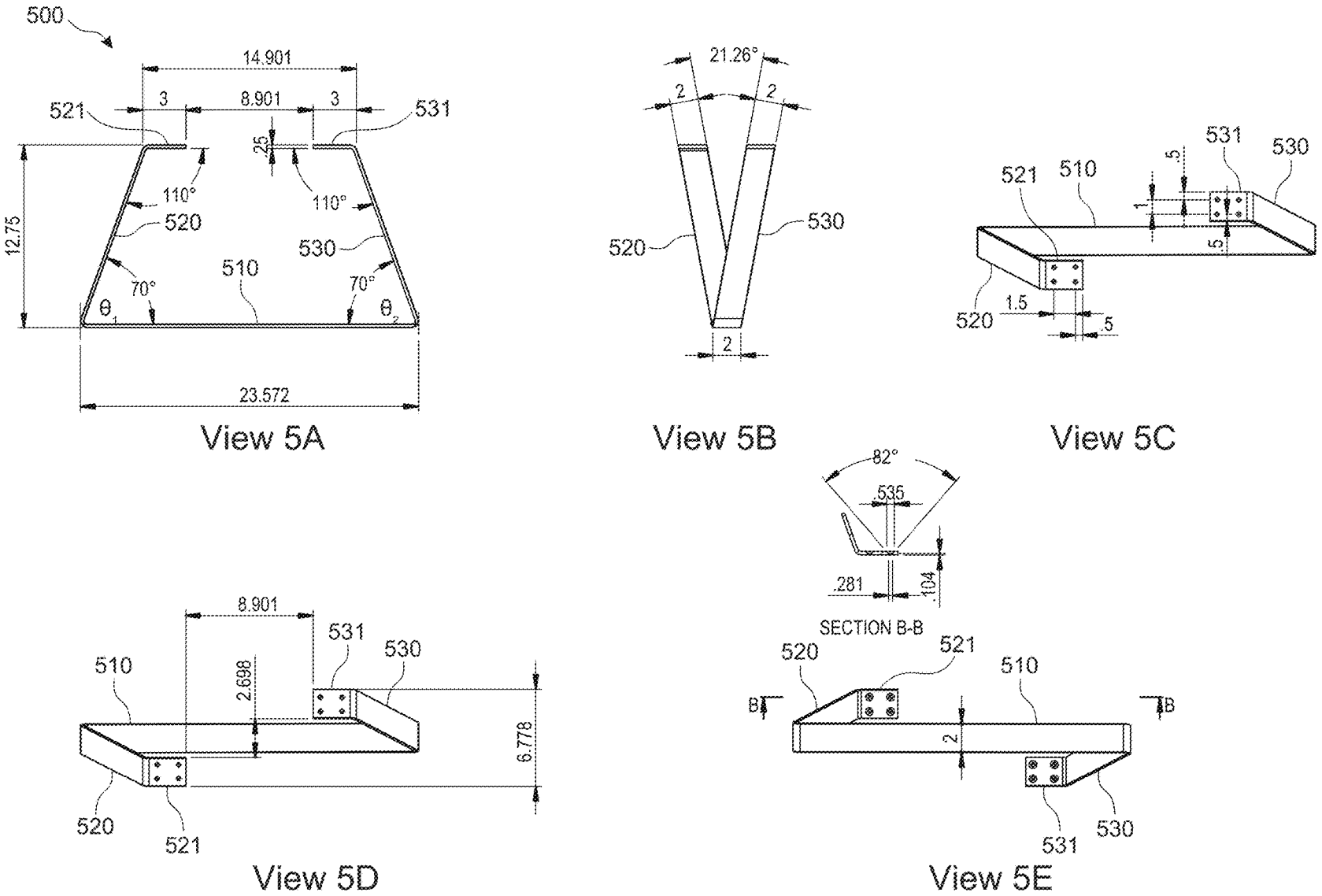
FIG. 5 illustrates an example second embodiment of a support structure with different dimensions than that of the support structure shown in FIG. 4.

FIG. 5 illustrates an example second embodiment of a support structure 500 with different dimensions than that of the support structure 400 shown in FIG. 4. FIG. 5 includes views 5A, 5B, 5C, 5D & 5E. In one example, view 5A illustrates a side view of the second embodiment of the support structure 500 with a primary member 510, a first secondary member 520 with first connecting piece 521 and a second secondary member 530 with second connecting piece 531. As illustrated in FIG. 5, the first connecting piece 521 and the second connecting piece 531 are each pointing outward relative to the support structure.

For example, the first secondary member 520 has a first cant angle $\theta_1$ of ~70 degrees. For example, the second secondary member 530 has a second cant angle $\theta_2$ of ~70 degrees. In one example, the first cant angle $\theta_1$ and the second cant angle $\theta_2$ are tilted with an inner cant (i.e., towards each other). In one example, the first connecting piece 521 is connected to the first secondary member 520 with a first connecting angle of ~110 degrees. In one example, the second connecting piece 531 is connected to the second secondary member 530 with a second connecting angle of ~110 degrees. In one example, view 5B illustrates a side view of the two secondary members 520 and 530.

Although dimensions of the support structure 500 are illustrated in FIG. 5, the dimensions may be viewed as one example showing proportions of the various members of the support structure 500 relative to one another. Additionally, the illustrated dimensions are only examples and one skilled in the art would understand that other proportions of the various members and other dimensions for the members of the support structure are within the scope and spirit of the present disclosure. And, in one aspect, the dimensions of each of the members of the support structure 500 may rely on particular applications (e.g., particular mechanical loads) of the support structure 500. Also, even though some sample dimensions are disclosed herein in FIGS. 4 and 5, one skilled in the art understands that this does not exclude other dimensions for the members of the support structure 400, 500 as, for example, particular dimensions of the members may depend on particular applications and/or mechanical loads.

In one example, view 5C illustrates a first top view of the second embodiment of the support structure 500 which shows the first connecting piece 521 and the second connecting piece 531 at the top of the support structure 500. In addition, FIG. 5C also shows the first secondary member 520 and the second secondary member 530 at the side of the support structure 500. In addition, FIG. 5C also shows the primary member 510 at the bottom of the support structure 500. In one example, view 5D illustrates a second top view of the second embodiment of the support structure 500 which shows additional dimensions from those shown in view 5C.

In one example, view 5E shows a bottom view of the second embodiment of the support structure 500 which shows the primary member 510 at the bottom of the support structure 500. In addition, view 5E also shows the first secondary member 520 and the second secondary member 530 at the side of the support structure 500. In addition, view 5E also shows the first connecting piece 521 and the second connecting piece 531 at the top of the support structure 500. In one example, the primary member 510 is coplanar with the foundation or floor (e.g., in the x-y plane). In one example, the primary member 510 will be connected to a mechanical load.

Figure 6:
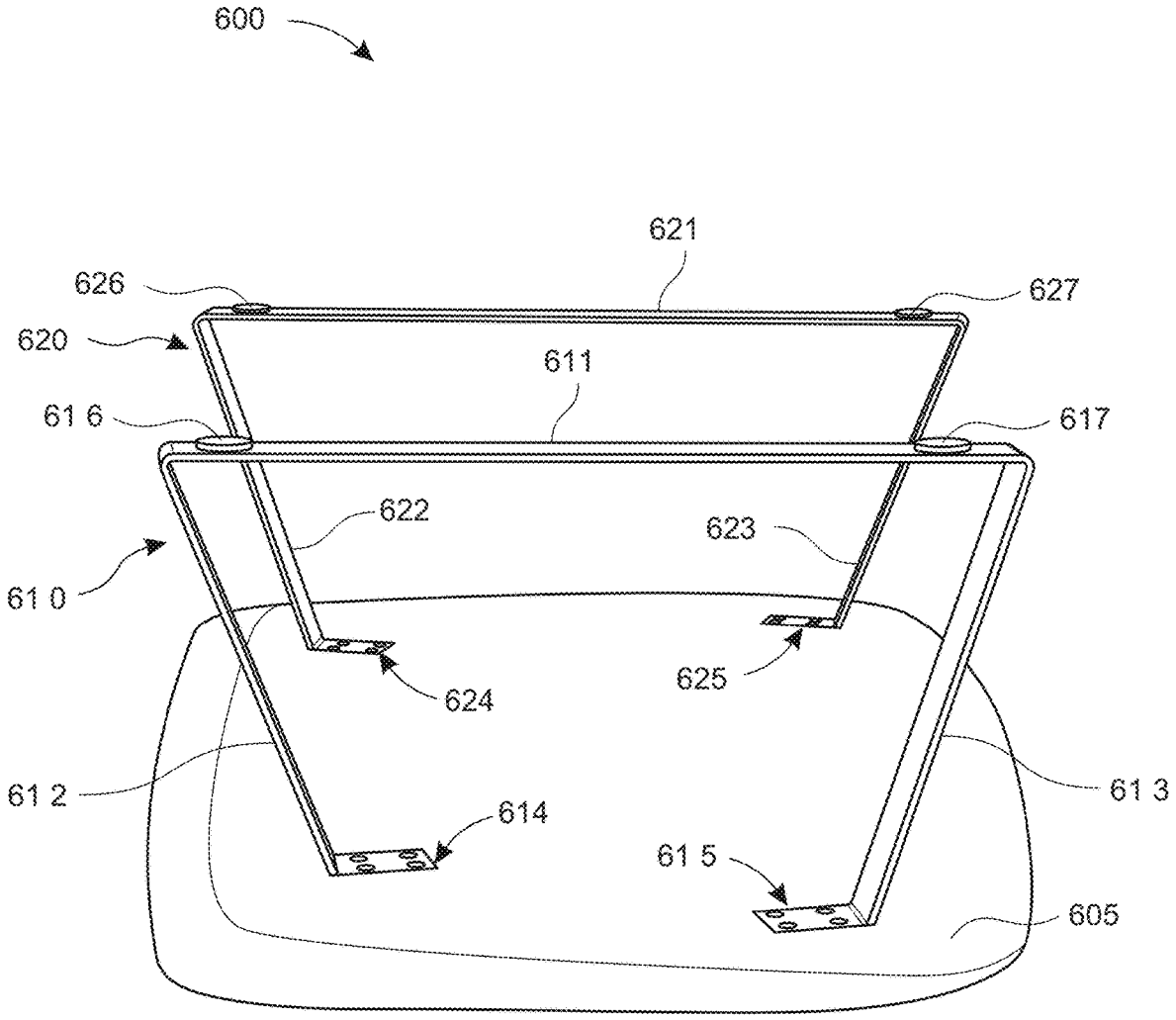
FIG. 6 illustrates an example of a first furniture table with a first support structure and a second support structure.

FIG. 6 illustrates an example of a first furniture table 600 with a first support structure 610 and a second support structure 620. In one example, the first support structure 610 includes a first primary member 611, a first secondary member 612 with a first connecting piece 614, a second secondary member 613 with a second connecting piece 615, a first floor pad 616 and a second floor pad 617. In one example, the second support structure 620 includes a second primary member 621, a third secondary member 622 with a third connecting piece 624, a fourth secondary member 623 with a fourth connecting piece 625, a third floor pad 626 and a fourth floor pad 627. In the example of FIG. 6, the placement of the first support structure 610 and the second support structure 620 on the mechanical load 605 (e.g., tabletop) is along the longer length of the mechanical load 605.

Figure 7:
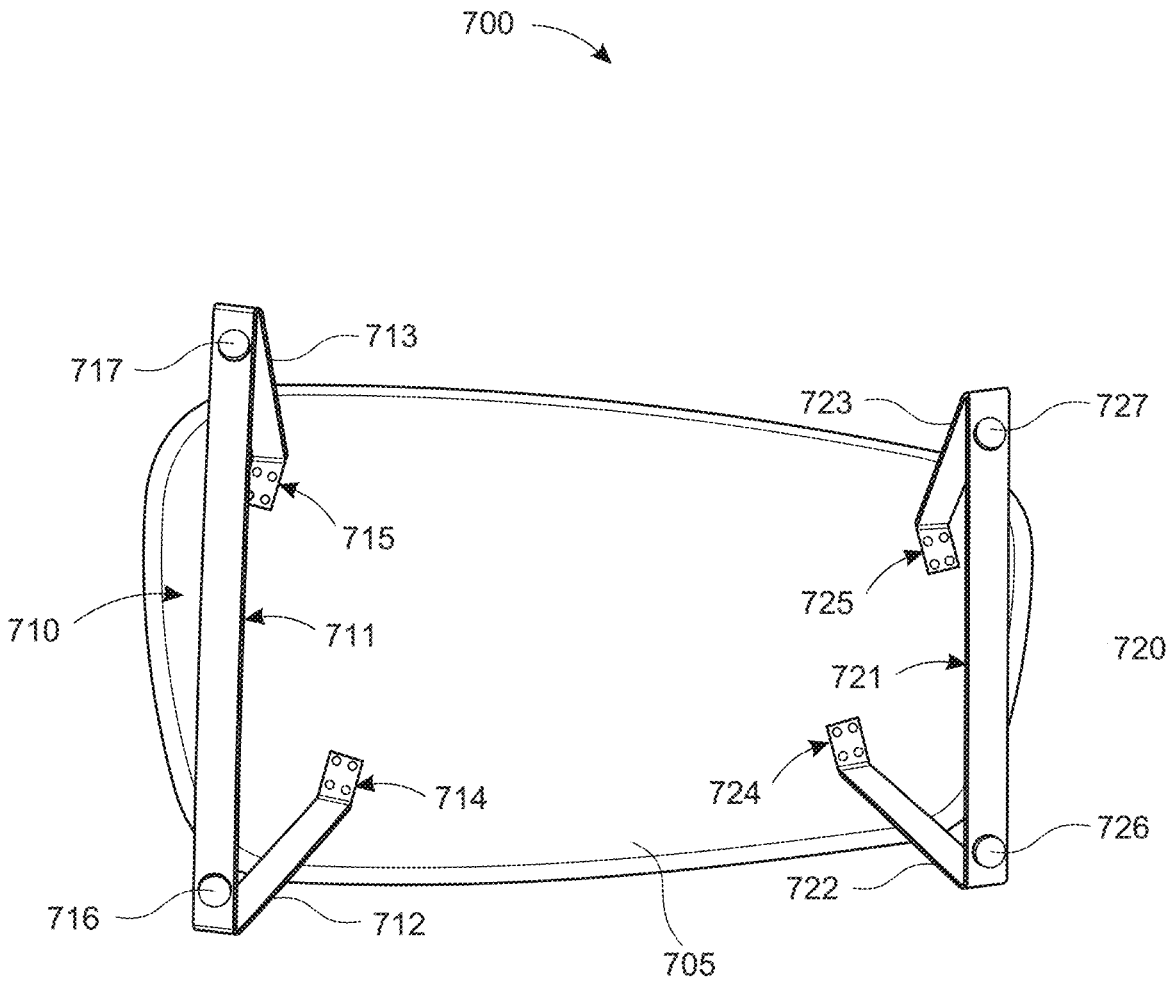
FIG. 7 illustrates an example of a second furniture table with a first support structure and a second support structure.

FIG. 7 illustrates an example of a second furniture table 700 with a first support structure 710 and a second support structure 720. In one example, the first support structure 710 includes a first primary member 711, a first secondary member 712 with a first connecting piece 714, a second secondary member 713 with a second connecting piece 715, a first floor pad 716 and a second floor pad 717. In one example, the second support structure 720 includes a second primary member 721, a third secondary member 722 with a third connecting piece 724, a fourth secondary member 723 with a fourth connecting piece 725, a third floor pad 726 and a fourth floor pad 727. In one example, the secondary members 712 and 713 are offset from the primary member 711 in opposite directions. That is, the second connecting piece 715 is to the left of the first primary member 711 while the first connecting piece 714 is to the right of the first primary member 711. In one example, the secondary members 722 and 723 are offset from the primary member 721 in opposite directions. That is, the third connecting piece 724 is to the left of the second primary member 721 while the fourth connecting piece 725 is to the right of the second primary member 721. In the example of FIG. 7, the placement of the first support structure 710 and the second support structure 720 on the mechanical load 705 (e.g., tabletop) is along the shorter length of the mechanical load 705.

Figure 8:
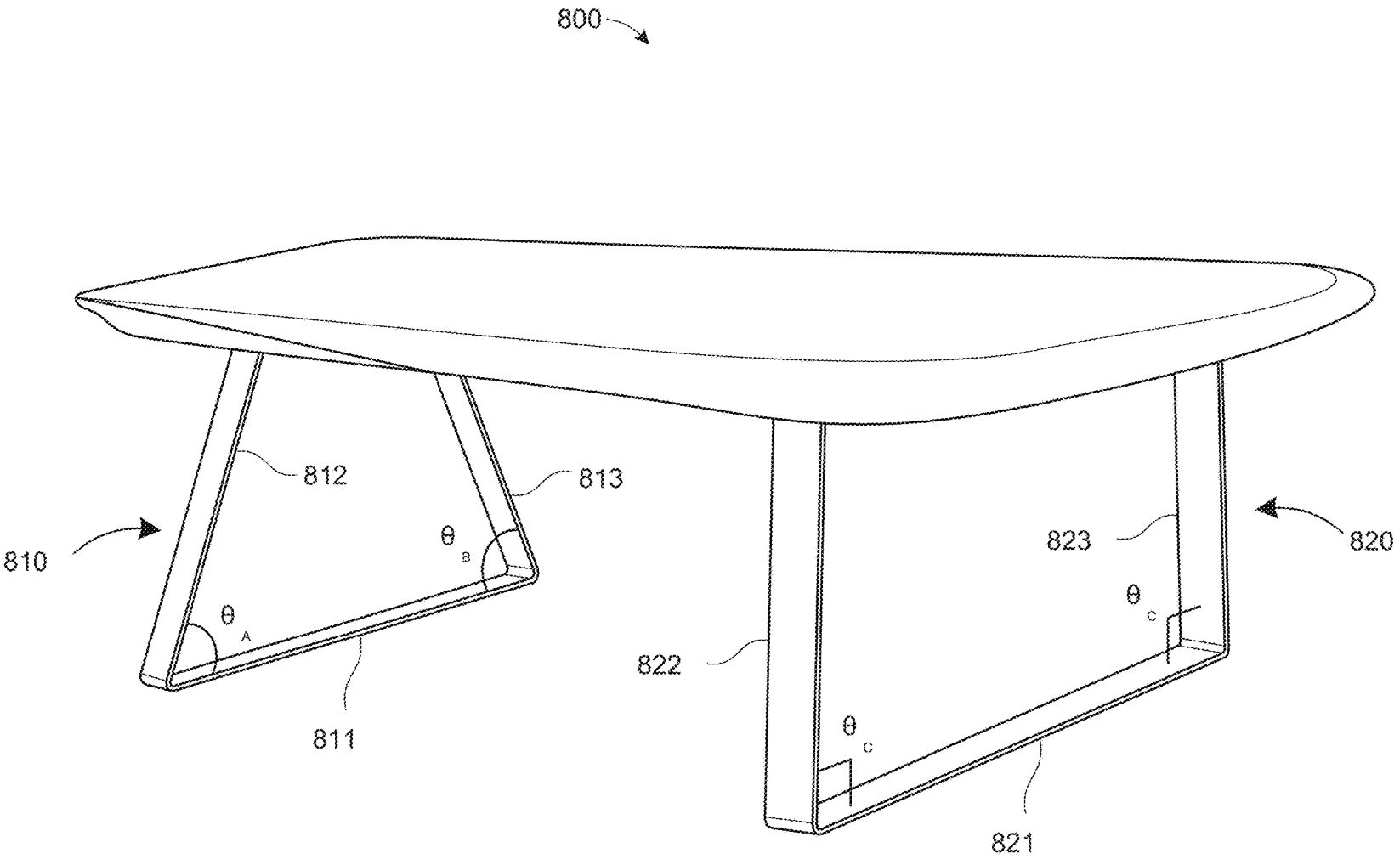
FIG. 8 illustrates an example of a third furniture table with a first support structure and a second support structure.

FIG. 8 illustrates an example of a third furniture table 800 with a first support structure 810 and a second support structure 820. In one example, the first support structure 810 includes a first primary member 811, a first secondary member 812 with a first connecting piece 814 (not shown), a second secondary member 813 with a second connecting piece 815 (not shown), a first floor pad 816 (not shown) and a second floor pad 817 (not shown). In one example, the second support structure 820 includes a second primary member 821, a third secondary member 822 with a third connecting piece 824 (not shown), a fourth secondary member 823 with a fourth connecting piece 825 (not shown), a third floor pad 826 (not shown) and a fourth floor pad 827

(not shown). In the third furniture table 800, the first support structure 810 differs from the second support structure 820 in that the angles $\theta_A$ and $\theta_B$ (associated with the first support structure 810) are each less than 90 degrees while the angle $\theta_C$ (associated with the second support structure 820) is at approximately 90 degrees. Also, in one example, the angles $\theta_A$ and $\theta_B$ each have a different value than the other. In another example, the angles $\theta_A$ and $\theta_B$ have the same value.

Figure 9:
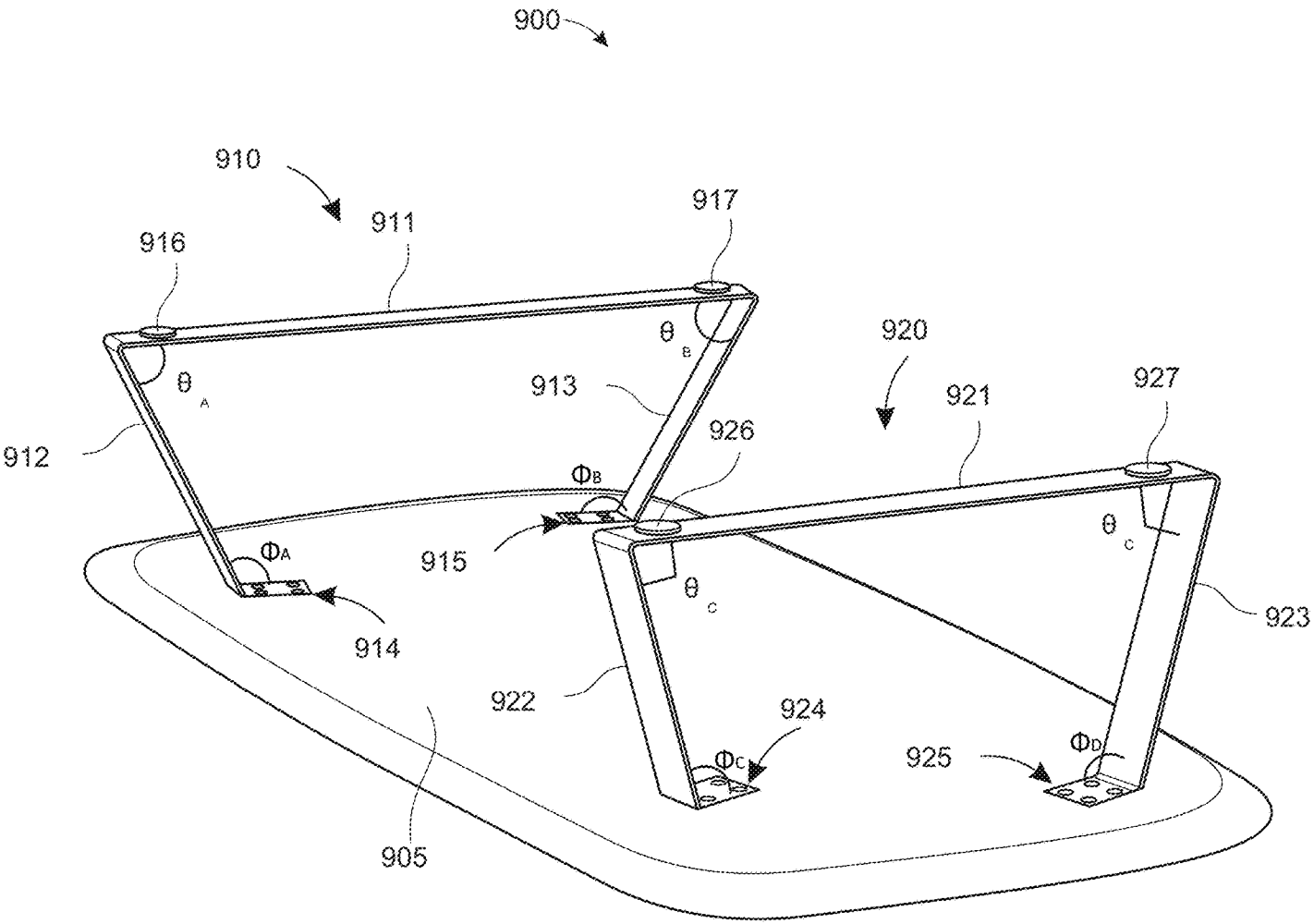
FIG. 9 illustrates an example of a fourth furniture table with a first support structure and a second support structure.

FIG. 9 illustrates an example of a fourth furniture table 900 with a first support structure 910 and a second support structure 920. In one example, the first support structure 910 includes a first primary member 911, a first secondary member 912 with a first connecting piece 914, a second secondary member 913 with a second connecting piece 915, a first floor pad 916 and a second floor pad 917. In one example, the second support structure 920 includes a second primary member 921, a third secondary member 922 with a third connecting piece 924, a fourth secondary member 923 with a fourth connecting piece 925, a third floor pad 926 and a fourth floor pad 927. In one example, the secondary members 912 and 913 are offset from the primary member 911 in opposite directions. In one example, the secondary members 922 and 923 are offset from the primary member 921 in opposite directions. Although only two support structures are shown in the various examples disclosed herein, one skilled in the art would understand that different quantities of support structures (e.g., a single support structure or more than two support structures) are not excluded and are also within the scope and spirit of the present disclosure.

In the fourth furniture table 900, the first support structure 910 differs from the second support structure 920 in that the angles $\theta_A$ and $\theta_B$ (associated with the first support structure 910) are each less than 90 degrees while the angle $\theta_C$ (associated with the second support structure 920) is at approximately 90 degrees. Also, in one example, the angles $\theta_A$ and $\theta_B$ each have a different value than the other. In another example, the angles $\theta_A$ and $\theta_B$ have the same value. In one example, the angles $\phi_A$ (between first connecting piece 914 and first secondary member 912), $\phi_B$ (between second connecting piece 915 and second secondary member 913), $\phi_C$ (between third connecting piece 924 and third secondary member 922), $\phi_D$ (between fourth connecting piece 925 and fourth secondary member 923) may each have angles that are less than 90 degrees and each angle may have different values. In one example, the values of each angle may depend on the mechanical load 905 (e.g., tabletop).

Figure 10:
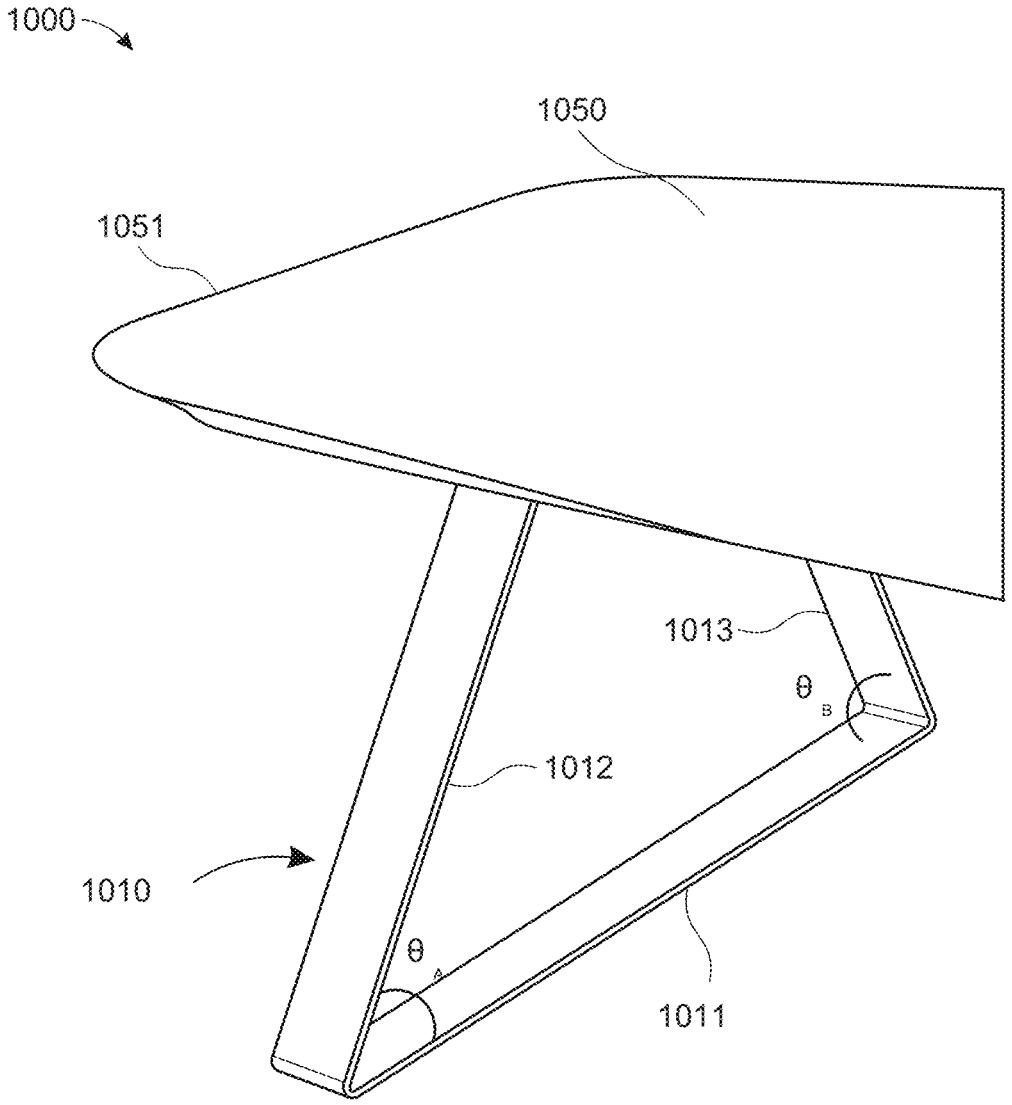
FIG. 10 illustrates an example of a fifth furniture table with a first support structure and a second support structure (not shown).

FIG. 10 illustrates an example of a fifth furniture table 1000 with a first support structure 1010 and a second support structure 1020 (not shown). In one example, the first support structure 1010 includes a first primary member 1011, a first secondary member 1012 and a second secondary member 1013. In one example, the first secondary member 1012 includes a first connecting piece 1014 (not shown) and a first floor pad 1016 (not shown), and the second secondary member 1013 includes a second connecting piece 1015 (not shown), and a second floor pad 1017 (not shown). In one example, the angles $\theta_A$ and $\theta_B$ each have a different value than the other. In another example, the angles $\theta_A$ and $\theta_B$ have the same value. In one example, the placement of the first support structure 1010 is near an edge 1051 of the mechanical load 1050 without restriction on the placement of the second support structure 1020. That is, the second support structure 1020 may be placed at another edge of the mechanical load 1050, at the center of the mechanical load 1050 or at any other position, without restriction.

Figure 11:
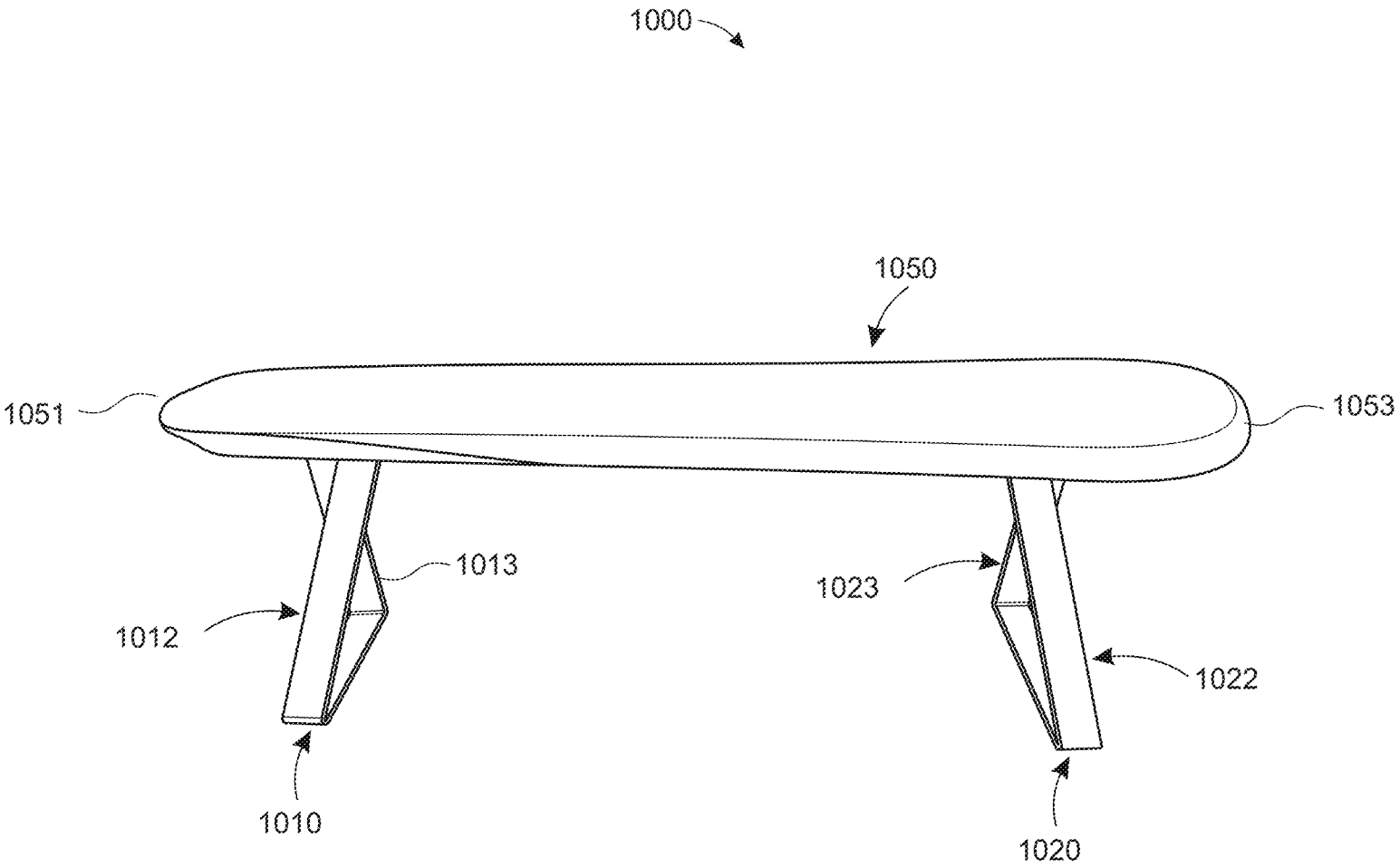
FIG. 11 illustrates a side view of the fifth furniture table of FIG. 10.
Figure 13:
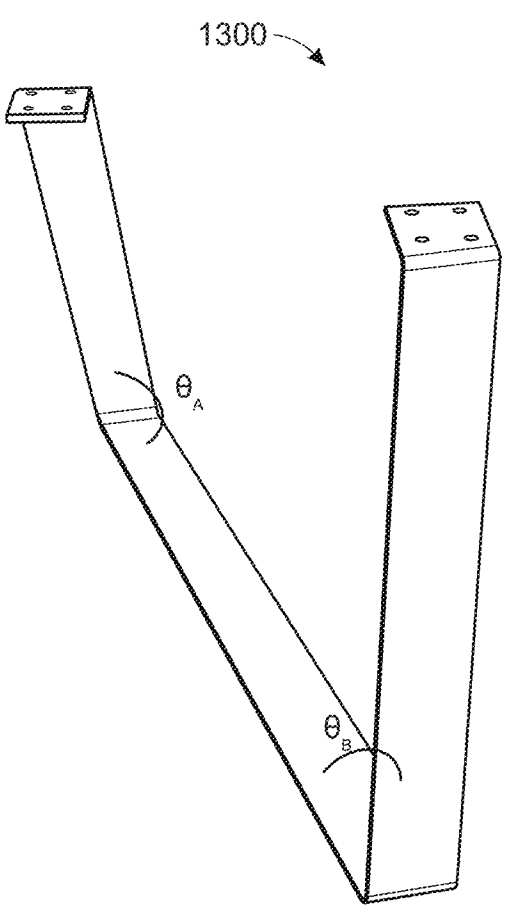
FIGS. 13-16 illustrate various example embodiments of support structures.

FIG. 11 illustrates a side view of the fifth furniture table 1000 of FIG. 10. As shown in FIG. 11, the first secondary member 1012 and the second secondary member 1013 (of the first support structure 1010) are attached to the mechanical load 1050 (e.g., the underside of the table surface) in a crisscross pattern (i.e., crisscross manner). And, as shown in FIG. 11, the third secondary member 1022 and the fourth secondary member 1023 (of the second support structure 1020) are attached to the mechanical load 1050 (e.g., the underside of the table surface) in a similar crisscross pattern. In one example, the placement of the first support structure 1010 and the placement of the second support structure 1020 is each respectively near an edge of the mechanical load 1050, albeit on opposite edges 1051, 1053.

Figure 12:
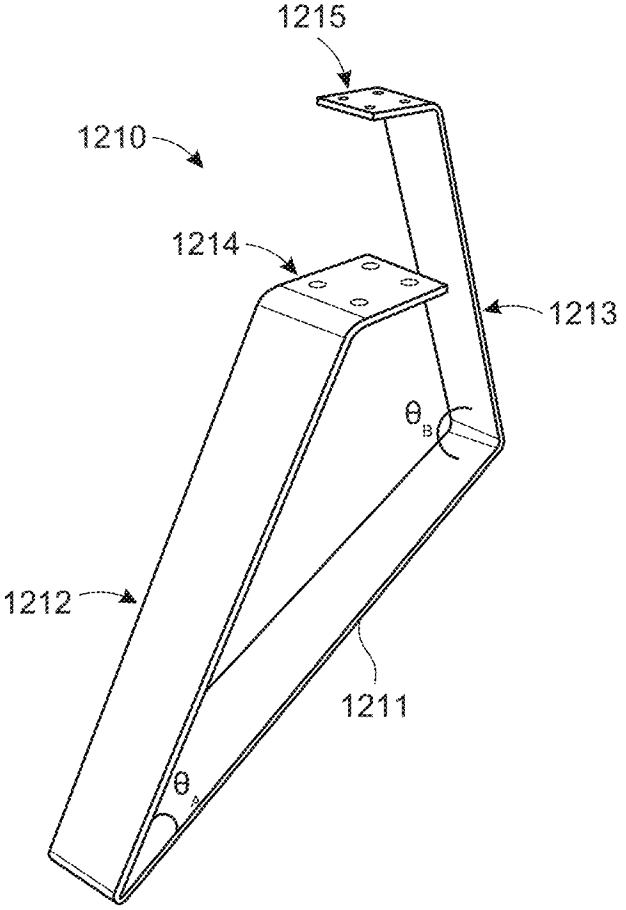
FIG. 12 illustrates an example of a support structure.
Figure 14:
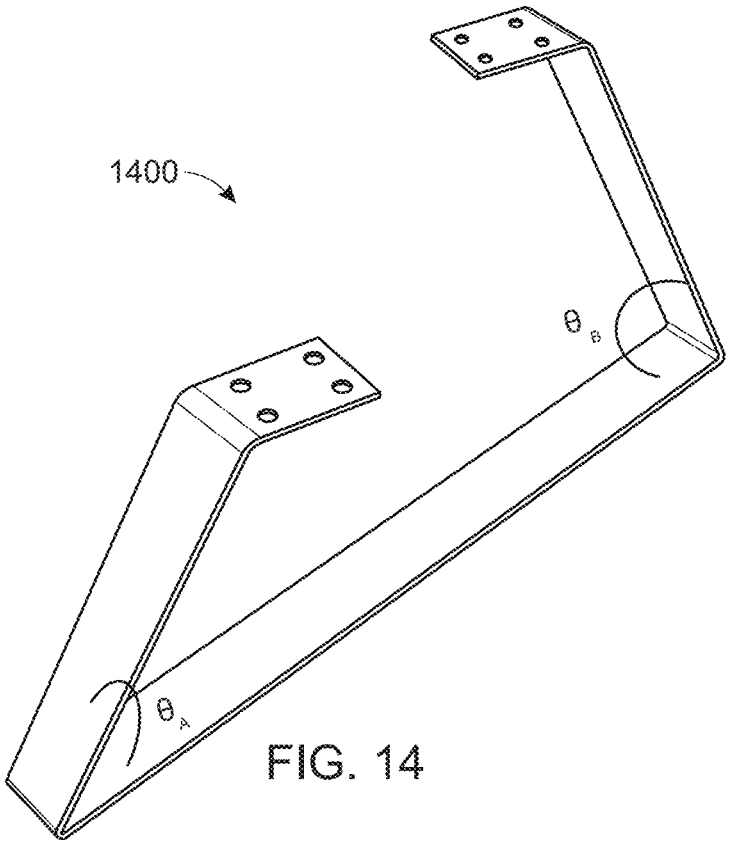
Figure 15:
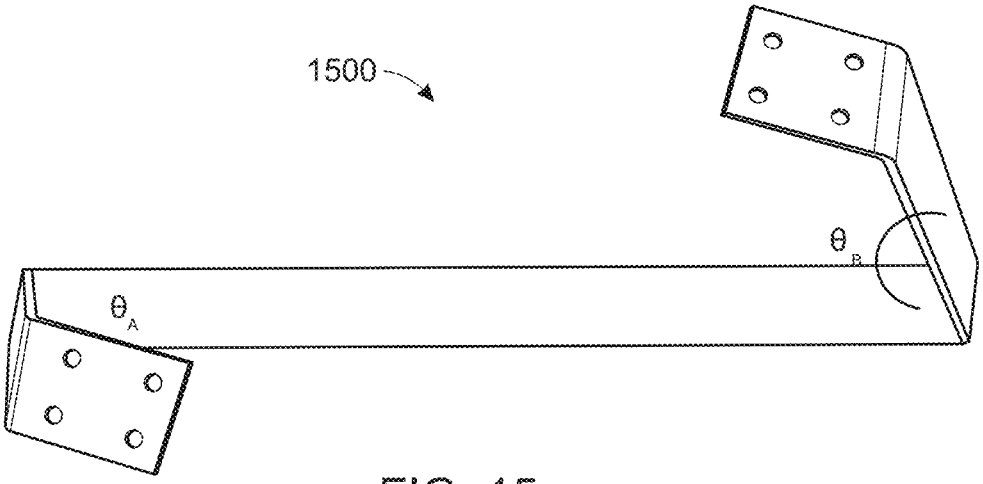
Figure 16:
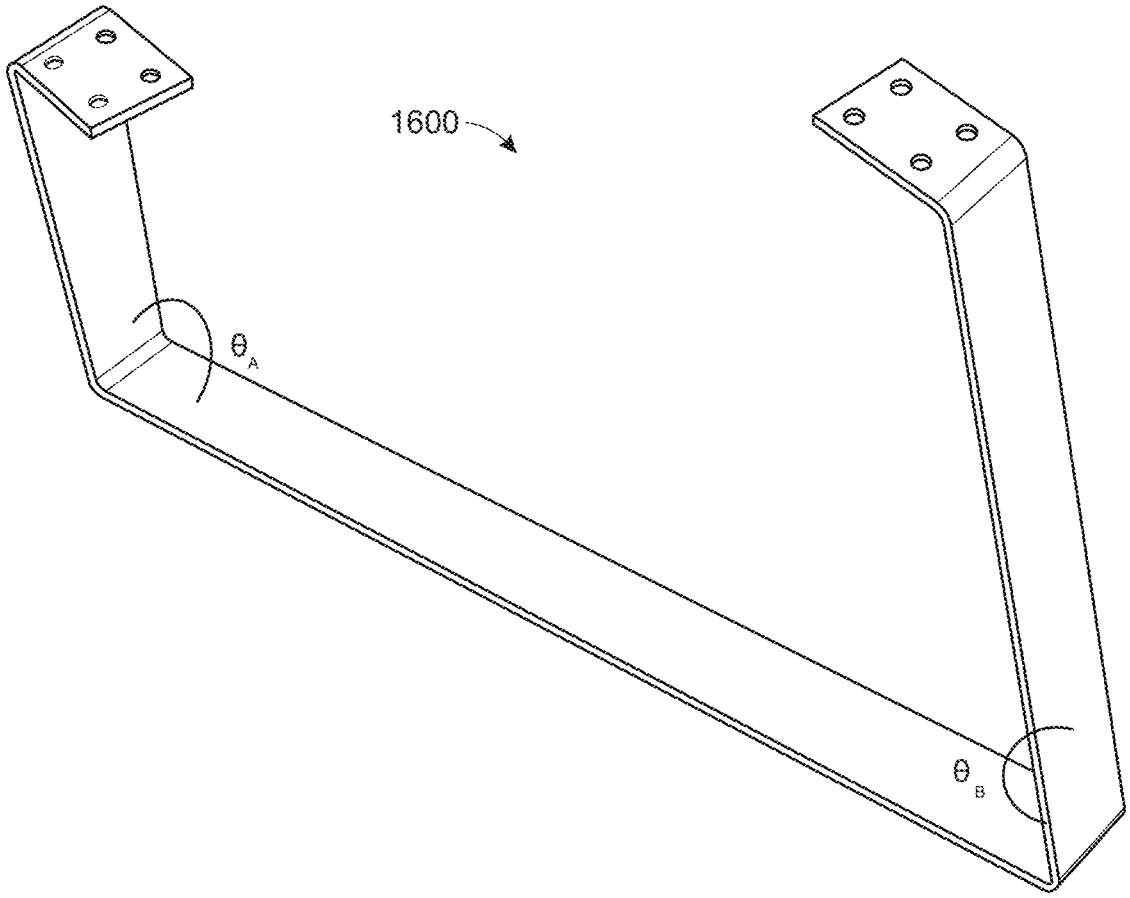

FIG. 12 illustrates an example of a support structure 1210. In one example, the support structure 1210 includes a primary member 1211, a first secondary member 1212 with a first connecting piece 1214 and a second secondary member 1213 with a second connecting piece 1215. In one example, the angles $\theta_A$ and $\theta_B$ each have a different value than the other. In another example, the angles $\theta_A$ and $\theta_B$ have the same value. In one example, the first secondary member 1212 and the second secondary member 1213 are attached to the underside of a surface (not shown), wherein the placement of the first connecting piece 1214 on the underside of the surface (not shown) is offset from the placement of the second connecting piece 1215.

FIGS. 13-16 illustrate various example embodiments of support structures 1300, 1400, 1500 1600. In some examples, the first secondary member and the second secondary member may have different lengths. In some examples, the angle (e.g., $\theta_A$) between the primary member and the first secondary member, and the angle (e.g., $\theta_B$) between the primary member and the second secondary member may have different values or may have equal values. In some examples, the placement of a first connecting piece (associated to a first secondary member) on an underside of a surface (not shown) is offset from the placement of a second connecting piece (associated to a second secondary member). In some other examples, there is no offset of the placements of the first connecting piece and the second connecting piece; that is, the placements are aligned to each other instead of crisscrossed.

Figure 17:
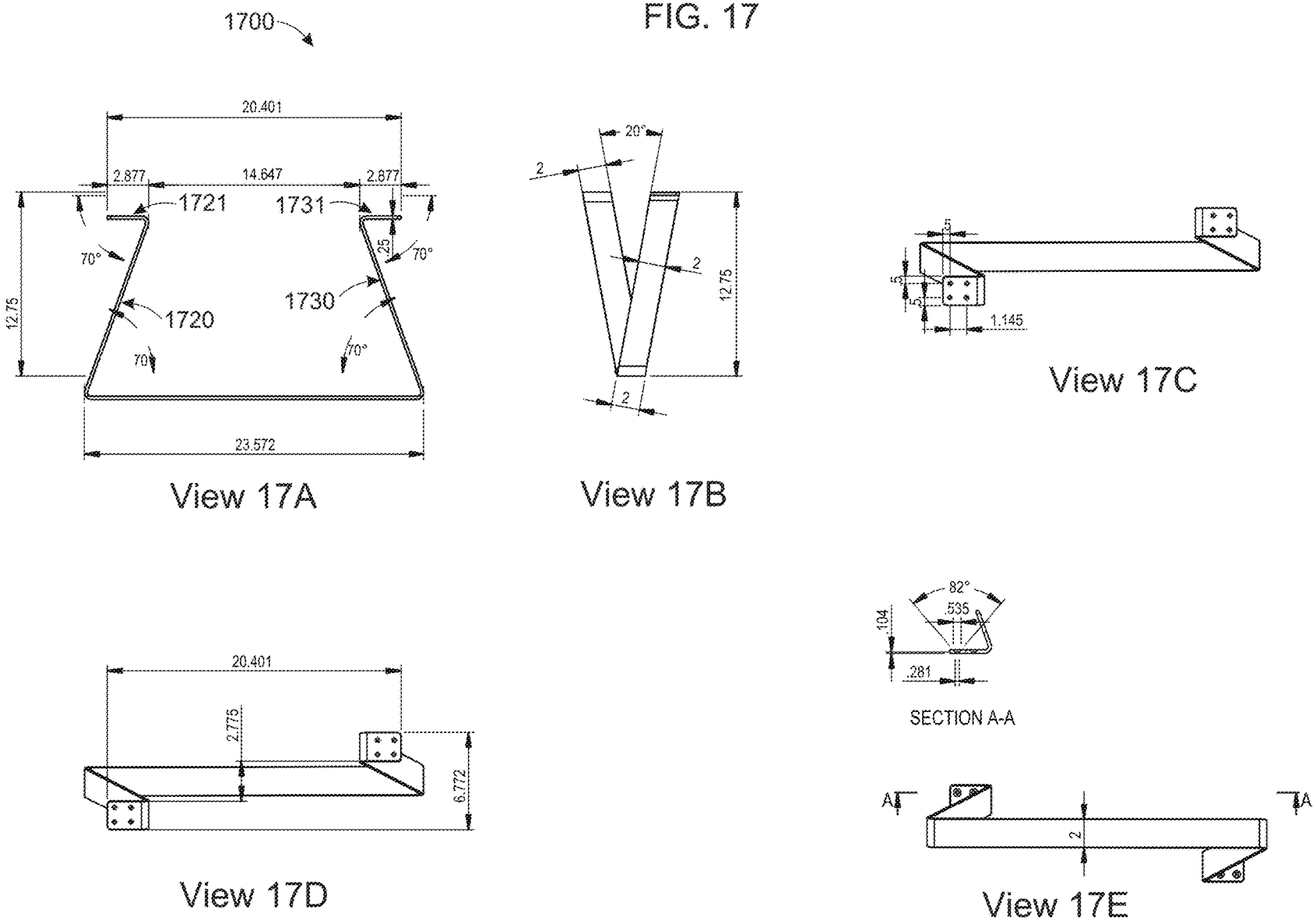
FIG. 17 illustrates an example third embodiment of a support structure.
Figure 18:
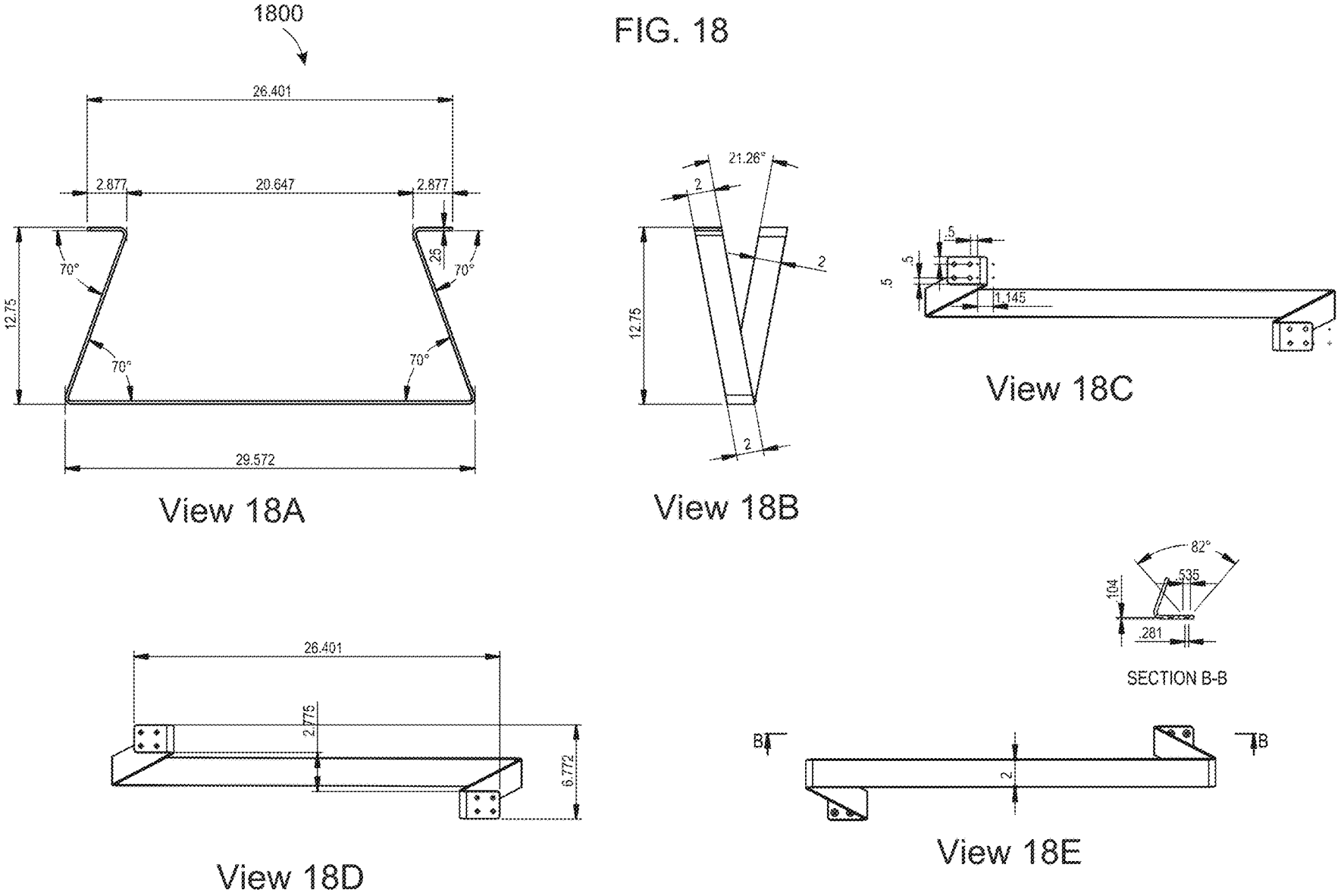
FIG. 18 illustrates an example fourth embodiment of a support structure with different dimensions than that of the support structure shown in FIG. 17.
Figure 19:
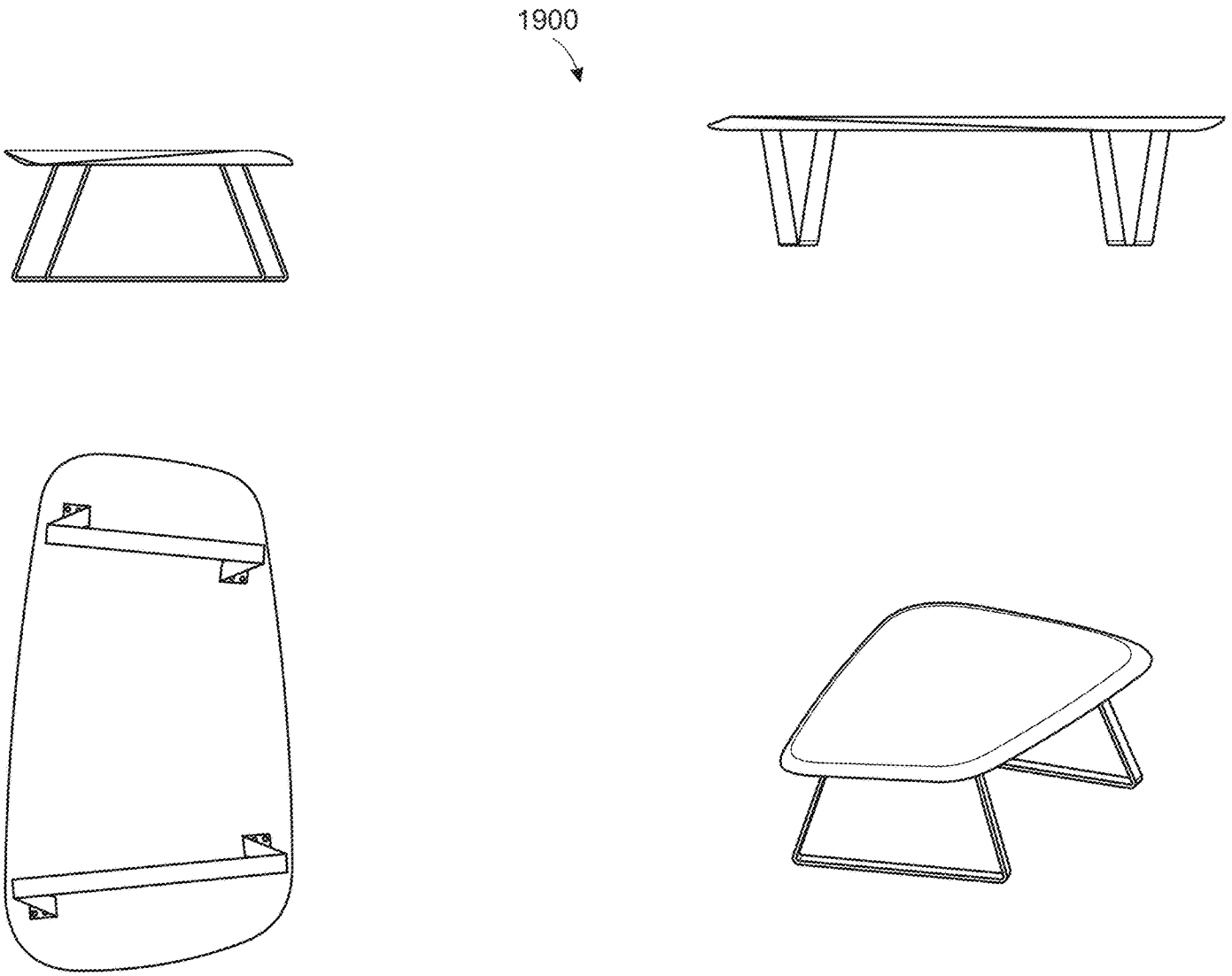
FIGS. 19-23 illustrate various example embodiments of support structures with some embodiments showing the support structures attached to a table surface.
Figure 20:
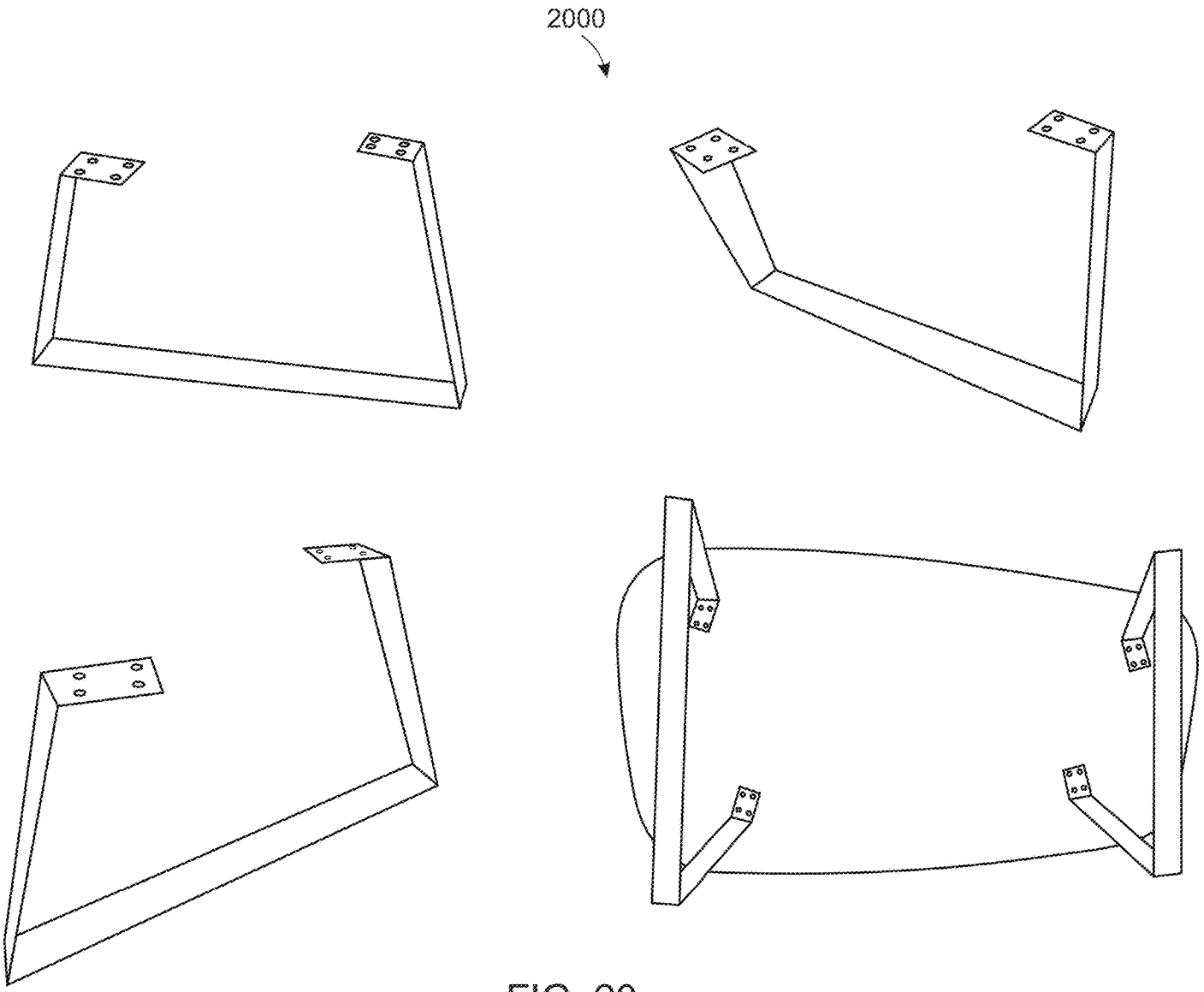
Figure 21:
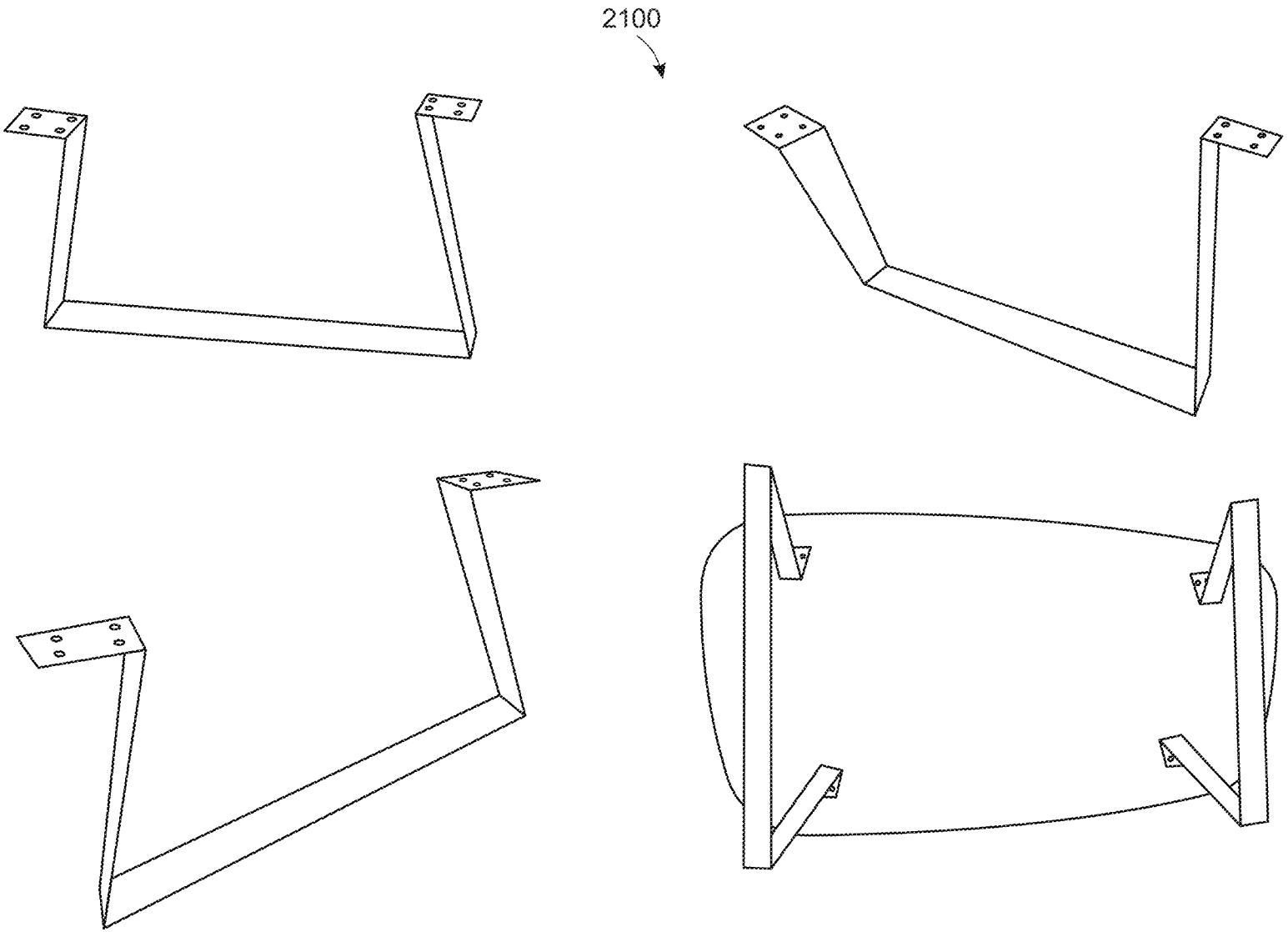
Figure 22:
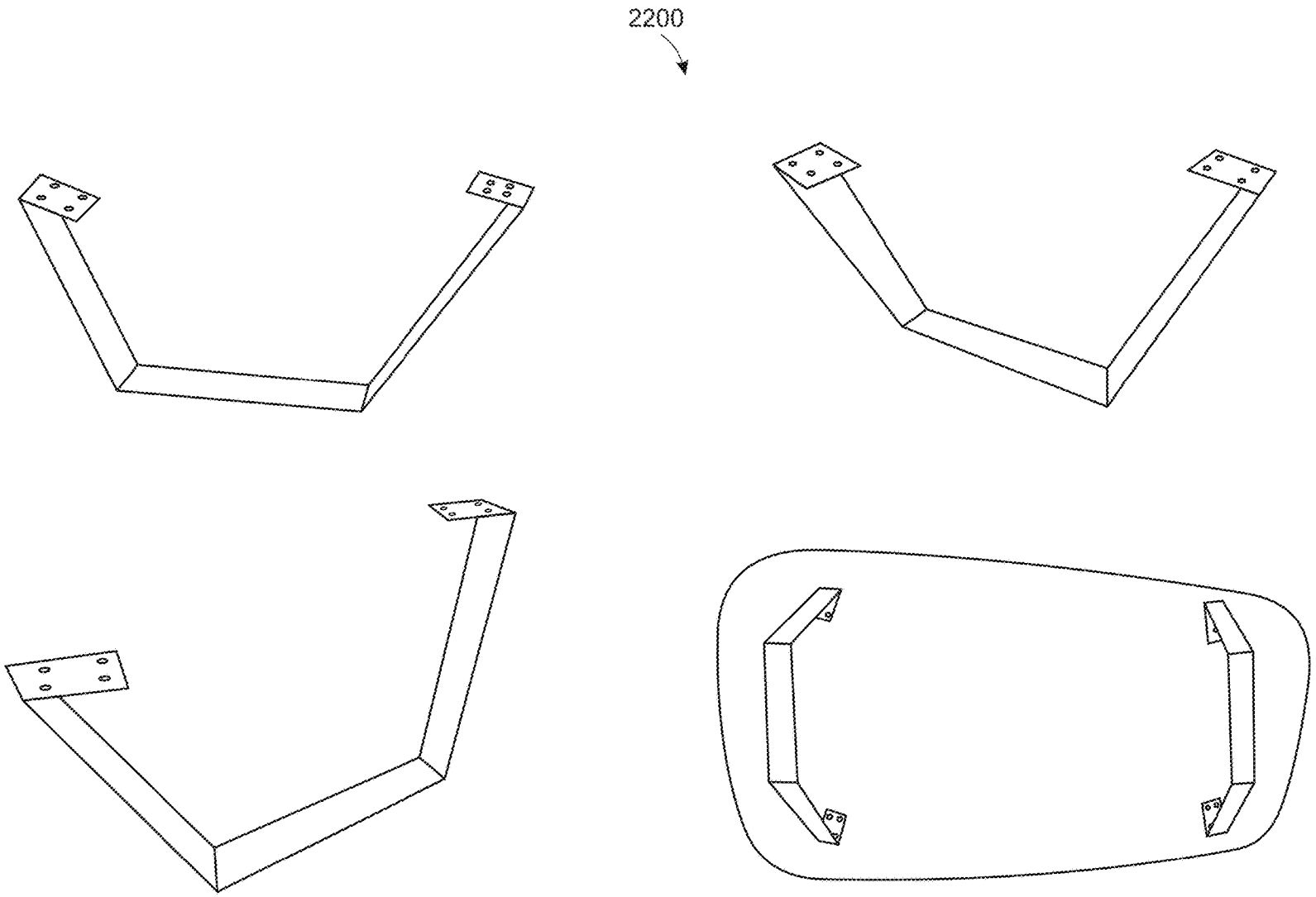
Figure 23:
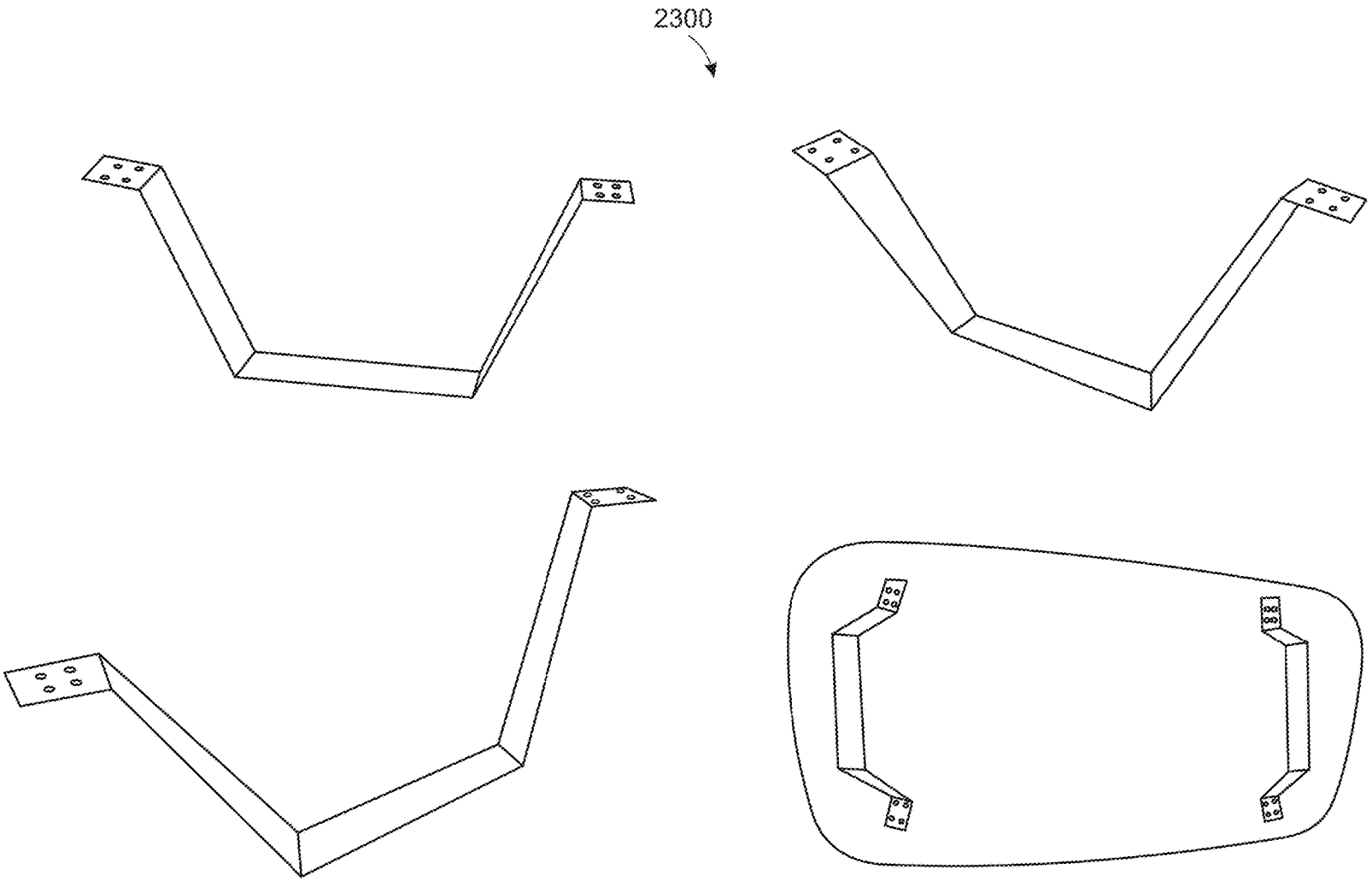

FIG. 17 illustrates an example third embodiment of a support structure 1700. FIG. 17 includes views 17A, 17B, 17C, 17D & 17E. The support structure 1700 differs from the support structure 400 (shown in FIG. 4) in that the first connecting piece 1721 and the second connecting piece 1731 each point outward from their respective first secondary member 1720 and second secondary member 1730, while in the example of FIG. 4, the first connecting piece 421 and the second connecting piece 431 (of the support structure 400 shown in FIG. 4) each point inward from their respective first secondary member 420 and second secondary member 430. FIG. 18 illustrates an example fourth embodiment of a support structure 1800 with different dimensions than that of the support structure shown in FIG. 17. FIG. 18 includes views 18A, 18B, 18C, 18D & 18E.

Although dimensions of the support structures 1700, 1800 are illustrated in FIGS. 17 and 18, the dimensions may be viewed as one example showing proportions of the various members of the support structures 1700, 1800 relative to one another. Additionally, the illustrated dimensions are only examples and one skilled in the art would understand that other proportions of the various members and other dimensions for the members of the support structure are within the scope and spirit of the present disclosure. And, in one aspect, the dimensions of each of the members of the support structures 1700, 1800 may rely on particular applications (e.g., particular mechanical loads) of the support structures 1700, 1800.

FIGS. 19-23 illustrate various example embodiments 1900, 2000, 2100, 2200, 2300 of support structures with some embodiments showing the support structures attached to a table surface. In some examples, the first secondary member and the second secondary member may have different lengths. In some examples, the angle (e.g., $\theta_A$) (not shown) between the primary member and the first secondary member, and the angle (e.g., $\theta_B$) (not shown) between the primary member and the second secondary member may have different values or may have equal values. In some examples, the placement of a first connecting piece (associated to a first secondary member) on an underside of a surface (not shown) is offset from the placement of a second connecting piece (associated to a second secondary member). This may allow the first secondary member and the second secondary member to be in a crisscross pattern relative to each other. In some other examples, there is no offset (i.e., offset=0) of the placements of the first connecting piece and the second connecting piece relative to each other; that is, the placements of the first connecting piece and the second connective piece are aligned to each other and the first secondary member and the second secondary member cannot be in a crisscross pattern from each other.

In some examples, one or more of the angles between a primary member and a secondary member is greater than 90 degrees. In some examples, the length of a first secondary member differs from the length of a second secondary member. In some examples, the connecting piece points inward from its respective secondary member. In other examples, the connecting piece points outward from its respective secondary member.

In one example, the support structure disclosed herein is a single mechanical piece. In one example, the support structure disclosed herein may have application for tables, flat surfaces of any type and dimension (e.g., a room ceiling, a room floor, etc.) and/or other building construction applications, etc.

Within the present disclosure, the word "exemplary" is used to mean "serving as an example, instance, or illustration." Any implementation or aspect described herein as "exemplary" is not necessarily to be construed as preferred or advantageous over other aspects of the disclosure. Likewise, the term "aspects" does not require that all aspects of the disclosure include the discussed feature, advantage or mode of operation. The term "coupled" is used herein to refer to the direct or indirect coupling between two objects. For example, if object A physically touches object B, and object B touches object C, then objects A and C may still be considered coupled to one another-even if they do not directly physically touch each other.

The previous description is provided to enable any person skilled in the art to practice the various aspects described herein. Various modifications to these aspects will be readily apparent to those skilled in the art, and the principles defined herein may be applied to other aspects. Thus, the claims are not intended to be limited to the aspects shown herein, but are to be accorded the full scope consistent with the language of the claims, wherein reference to an element in the singular is not intended to mean "one and only one" unless specifically so stated, but rather "one or more." Unless specifically stated otherwise, the term "some" refers to one or more. A phrase referring to "at least one of" a list of items refers to any combination of those items, including single members. As an example, "at least one of: a, b, or c" is intended to cover: a; b; c; a and b; a and c; b and c; and a, b and c. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for."

One skilled in the art would understand that various features of different embodiments may be combined or modified and still be within the spirit and scope of the present disclosure.

What is claimed is:

1. An apparatus comprising a first primary member;

a first secondary member connected to the first primary member at a first point and wherein the first secondary member connects to the first primary member at a first angle at the first point;

a first connecting piece connected to the first secondary member at a second point and wherein the first connecting piece connects to the first secondary member at a second angle at the second point;

a second secondary member connected to the first primary member at a third point and wherein the second secondary member connects to the first primary member at a third angle at the third point;

a second connecting piece connected to the second secondary member at a fourth point and wherein the second connecting piece connects to the second secondary member at a fourth angle at the fourth point;

a planar surface connected to the first connecting piece and the second connecting piece, wherein the first connecting piece is offset relative to a first line projected onto the surface by the first primary member and the second connecting piece is offset in an opposite direction relative to the first line;

a second primary member;

a third secondary member connected to the second primary member at a fifth point and wherein the third secondary member connects to the second primary member at a fifth angle at the fifth point;

a third connecting piece connected to the third secondary member;

a fourth secondary member connected to the second primary member at a sixth point and wherein the fourth secondary member connects to the second primary member at a sixth angle at the sixth point;

a fourth connecting piece connected to the fourth secondary member;

wherein the third connecting piece connects to the planar surface, and the fourth connecting piece connects to the planar surface; and wherein the third secondary member and the fourth secondary member form a first crisscrossed pattern.

2. The apparatus of claim 1, wherein the first secondary member and the second secondary member form a second crisscrossed pattern.

3. The apparatus of claim 2, wherein each of the first connecting piece and the second connecting piece points inward relative to each other.

4. The apparatus of claim 3, wherein each of the third connecting piece and the fourth connecting piece points inward relative to each other.

5. The apparatus of claim 4, further comprising a first floor pad, a second floor pad, a third floor pad and a fourth floor pad, wherein the first floor pad and the second floor pad are connected to the first primary member, and wherein the third floor pad and the fourth floor pad are connected to the second primary member.

6. The apparatus of claim 2, wherein each of the first connecting piece and the second connecting piece points outward relative to each other.

7. The apparatus of claim 6, wherein each of the third connecting piece and the fourth connecting piece points outward relative to each other.

8. The apparatus of claim 7, further comprising a first floor pad, a second floor pad, a third floor pad and a fourth floor pad, wherein the first floor pad and the second floor pad are connected to the first primary member, and wherein the third floor pad and the fourth floor pad are connected to the second primary member.

9. The apparatus of claim 1, wherein the first connecting piece is offset to the left relative to the first line;

the second connecting piece is offset to the right relative to the first line;

the third connecting piece is offset to the right relative to the second line; and the fourth connecting piece is offset to the left relative to the second line to form a first distance between the first connecting piece and the third connecting piece and a second distance between the second connecting piece and the fourth connecting piece such that the first distance is longer than the second distance.

10. The apparatus of claim 1, wherein the first connecting piece is offset to the right relative to the first line;

the second connecting piece is offset to the left relative to the first line;

the third connecting piece is offset to the left relative to the second line; and the fourth connecting piece is offset to the right relative to the second line to form a first distance between the first connecting piece and the third connecting piece and a second distance between the second connecting piece and the fourth connecting piece such that the first distance is shorter than the second distance.

* * * * *